US005499458A

United States Patent [19]

Krunic

[11] Patent Number: 5,499,458

[45] Date of Patent: Mar. 19, 1996

[54] ATTACHMENTS FOR SHOES FOR WALKING ON ICY SURFACES

[76] Inventor: Michael K. Krunic, 201 Miracle Mile Dr., Apt. 1-H, Anderson, S.C. 29621

[21] Appl. No.: 307,020

[22] Filed: Sep. 16, 1994

[51] Int. Cl.[6] ..... A43C 15/06

[52] U.S. Cl. ..... 36/7.6; 36/62

[58] Field of Search ..... 36/7.6, 7.7, 7.1 R, 36/62, 7.5, 59 R, 115, 124, 11.5, 121, 122

[56] References Cited

U.S. PATENT DOCUMENTS

| | | | |
|---|---|---|---|
| 183,949 | 10/1876 | Lowenthal | 36/7.6 |
| 577,475 | 2/1897 | Zandalazini | 36/7.6 |
| 2,193,943 | 3/1940 | Shea | 36/7.6 X |

FOREIGN PATENT DOCUMENTS

| | | | |
|---|---|---|---|
| 0176041 | 4/1986 | European Pat. Off. | 36/11.5 |
| 0275992 | 8/1930 | Italy | 36/7.6 |
| 0553116 | 12/1956 | Italy | 36/11.5 |
| 0439015 | 12/1967 | Switzerland | 36/7.6 |
| 0612411 | 11/1948 | United Kingdom | 36/11.5 |

*Primary Examiner*—Jacob K. Ackun
*Assistant Examiner*—Ted Kavanaugh

[57] ABSTRACT

An ice cleat for securement to existing foot wear to aid in walking on icy surfaces, comprising a base piece which has a foot-like shape periphery. The base piece has an upper surface, a lower surface, a toe portion, a heel portion, a right side portion, and a left side portion. The base piece has open sections therethrough. A plurality of holes extend through the base piece from the upper surface to the lower surface around the entire periphery and interiorly thereof. A plurality of nails have a pointed end and a head end. The head end is positioned upon the upper surface with the point end extending beyond the lower surface. A plurality of straps are coupled to the base piece for securing the base piece to the foot of a wearer.

1 Claim, 3 Drawing Sheets

ATTACHMENTS FOR SHOES FOR WALKING ON ICY SURFACES

BACKGROUND OF THE INVENTION

1. Field of the Invention

The present invention relates to ice cleats and more particularly pertains to securing traction surfaces to existing footwear so as to aid in walking on icy surfaces.

2. Description of the Prior Art

The use of shoe attachment of a wide variety of designs and configurations is known in the prior art. More specifically, shoe attachment of a wide variety of designs and configurations heretofore devised and utilized for the purpose of providing traction or other walking assistance through a wide variety of methods and apparatuses are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 257,908 to Inohara discloses the ornamental design for a cleat plate for a sport shoe sole.

U.S. Pat. No. 3,834,045 to Crigger et al. discloses snow and ice anti-skid devices for shoes consisting of a pair of metal bars connected pivotally together at their centers.

U.S. Pat. No. Des. 299,285 to Watson discloses the ornamental design for an ice gripping shoe attachment.

U.S. Pat. No. 4,286,396 to Deacon discloses a traction device for walking on ice.

U.S. Pat. No. 4,318,231 to Simoneau discloses an ice stud for shoes.

U.S. Pat. No. 3,693,271 to Korpel discloses a built-in retractable ice spur device for shoe heels.

In this respect, the ice cleats according to the present invention substantially depart from the conventional concepts and designs of the prior art, and in so doing provide an apparatus primarily developed for the purpose of securing traction surfaces to existing footwear so as to aid in walking on icy surfaces.

Therefore, it can be appreciated that there exists a continuing need for new and improved ice cleats which can be used for securing traction surfaces to existing footwear so as to aid in walking on icy surfaces. In this regard, the present invention substantially fulfills this need.

SUMMARY OF THE INVENTION

In view of the foregoing disadvantages inherent in the known types of shoe attachment of a wide variety of designs and configurations now present in the prior art, the present invention provides improved ice cleats. As such, the general purpose of the present invention, which will be described subsequently in greater detail, is to provide a new and improved ice cleats apparatus and method which has all the advantages of the prior art and none of the disadvantages.

To attain this, the present invention essentially comprises a new and improved ice cleat for securing to existing footwear to aid in walking on icy surfaces comprising, in combination, a base piece having a foot-like shape periphery. The base piece has an upper surface, a lower surface, a toe portion, a heel portion, a right side portion, and a left side portion. The base piece has a front open section with cross braces to form four generally triangular openings, a back open section with cross braces to form four generally triangular openings and a center generally rectangular opening. A plurality of holes extend through the base piece from the upper surface to the lower surface around the entire peripheral shape as well as through the front cross brace, rear cross brace and around the center open section. A plurality of nails have a lower end with a point and an upper end with a head. The head is positioned upon the upper surface with the point end extending beyond the lower surface for a distance of between about 0.25 and 0.50 inch. Its nails have a common diameter such as to be fictionally supported within its associated hole. A forward strap pair has interior ends with a loop and rod therethrough, secured to the side portion at the periphery of the base piece and a rearward strap pair having interior ends with a loop and rod therethrough secured to the side portion at the periphery of the base piece. Each strap pair has an external end with a male buckle member and a female buckle member to allow for the removable coupling therebetween. A front attachment strap has an interior end with a loop and rod therethrough secured to the toe portion of the periphery of the base piece and a rear attachment strap which has an internal end with a loop and rod therethrough secured to the periphery of the base piece. The front strap piece has a loop at its outboard end for receiving the front strap pair and the rear strap piece has a loop at its outboard end for receiving a portion of the rear strap pair. Openings in the base piece extend from interior of the base piece to the periphery of the base piece and molded into the base piece for receiving the interior end of the strap pairs and straps for added securement between the base piece, the straps and strap pairs.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved ice cleats which have all the advantages of the prior art shoe attachment of a wide variety of designs and configurations and none of the disadvantages.

It is another object of the present invention to provide new and improved ice cleats which may be easily and efficiently manufactured and marketed.

It is a further object of the present invention to provide new and improved ice cleats which are of a durable and reliable construction.

An even further object of the present invention is to provide new and improved ice cleats which are susceptible of a low cost of manufacture with regard to both materials and labor, and which accordingly are then susceptible of low prices of sale to the consuming public, thereby making such shoe attachment of a wide variety of designs and configurations economically available to the buying public.

Still yet another object of the present invention is to provide new and improved ice cleats which provide in the apparatuses and methods of the prior art some of the advantages thereof, while simultaneously overcoming some of the disadvantages normally associated therewith.

Still another object of the present invention is to secure traction surfaces to existing footwear so as to aid in walking on icy surfaces.

Lastly, it is an object of the present invention to provide new and improved ice cleats for securement to existing foot wear to aid in walking on icy surfaces. The present invention comprises a base piece which has a foot-like shape periphery. The base piece has an upper surface, a lower surface, a toe portion, a heel portion, a right side portion, and a left side portion. The base piece has open sections therethrough. A plurality of holes extend through the base piece from the upper surface to the lower surface around the entire periphery and interiorly thereof. A plurality of nails have a pointed end and a head end. The head end is positioned upon the upper surface with the point end extending beyond the lower surface. A plurality of straps are coupled to the base piece for securing the base piece to the foot of a wearer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
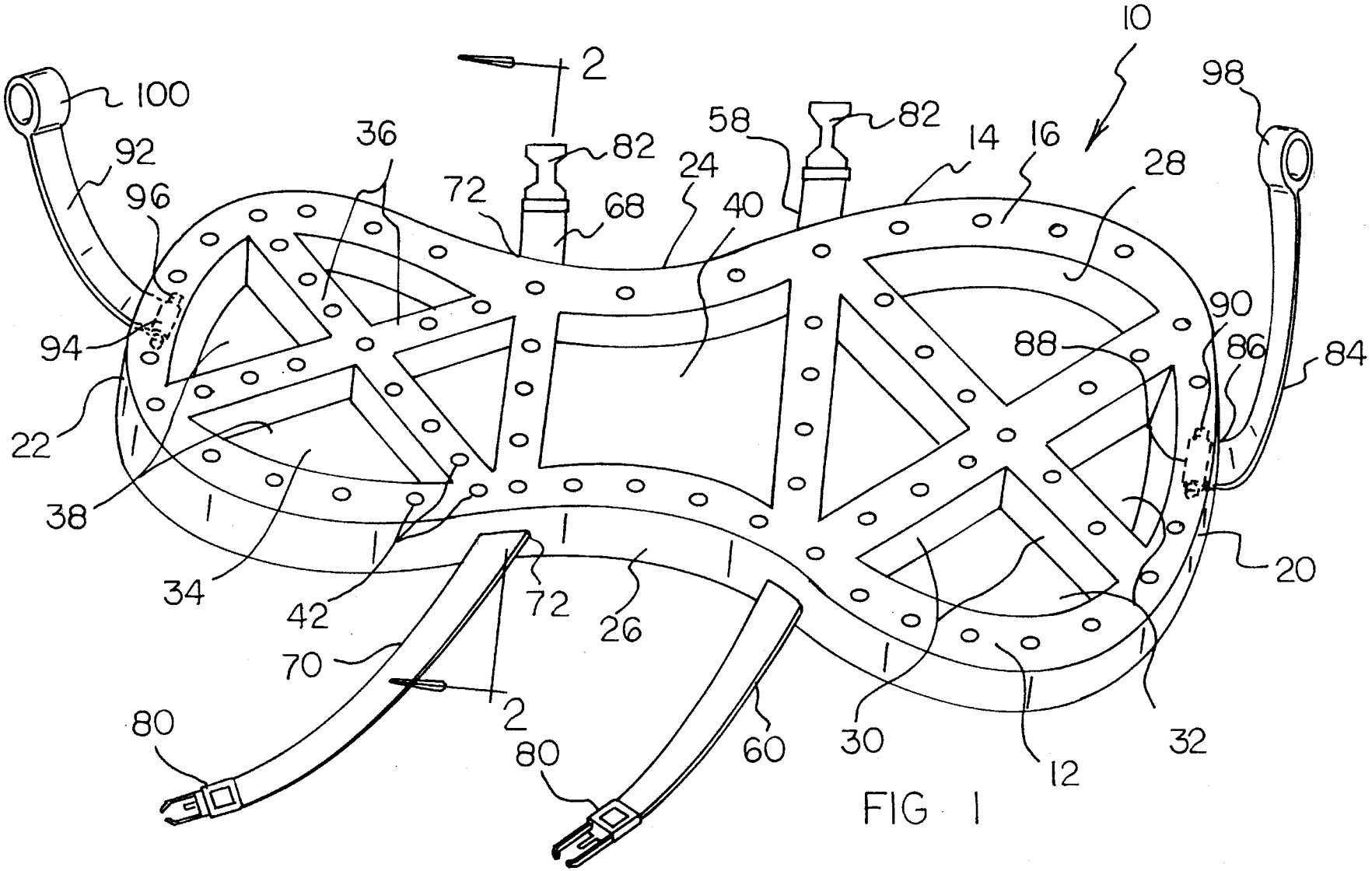
FIG. 1 is a perspective illustration of the preferred embodiment of the ice cleats constructed in accordance with the principles of the present invention.
Figure 2:
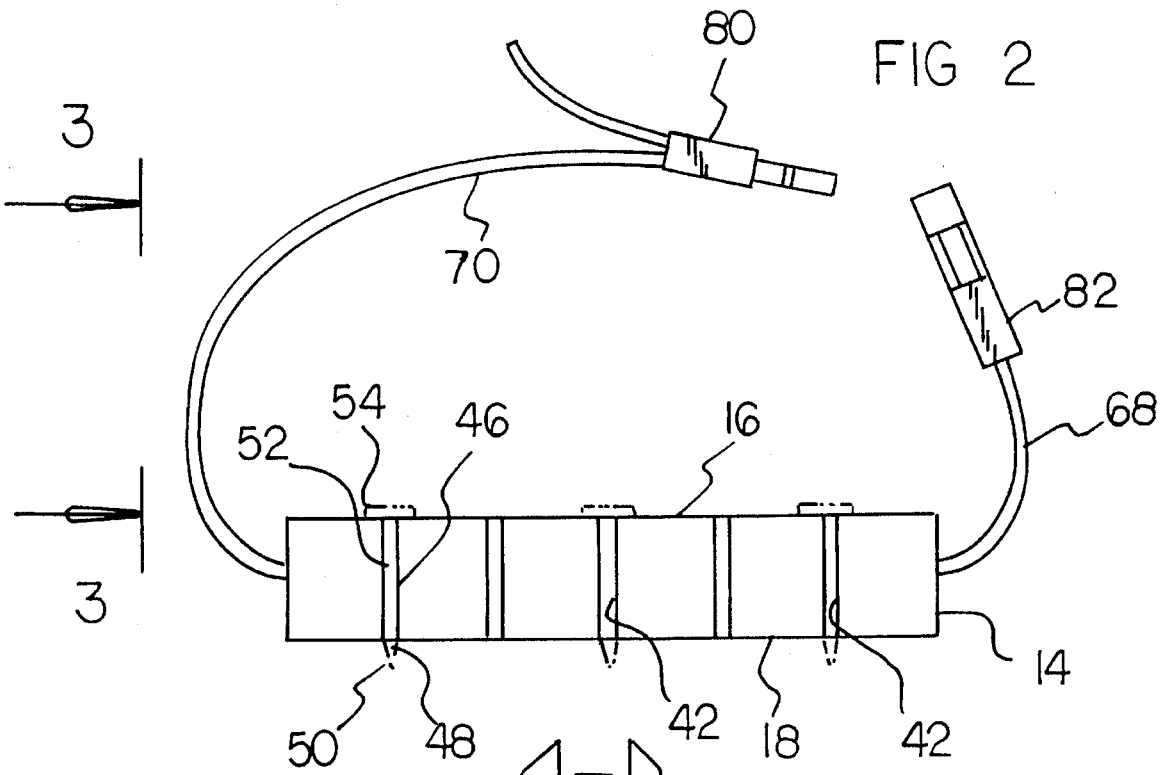
FIG. 2 is a cross-sectional view of the device shown in FIG. 1 taken along line 2—2 of FIG. 1.
Figure 3:
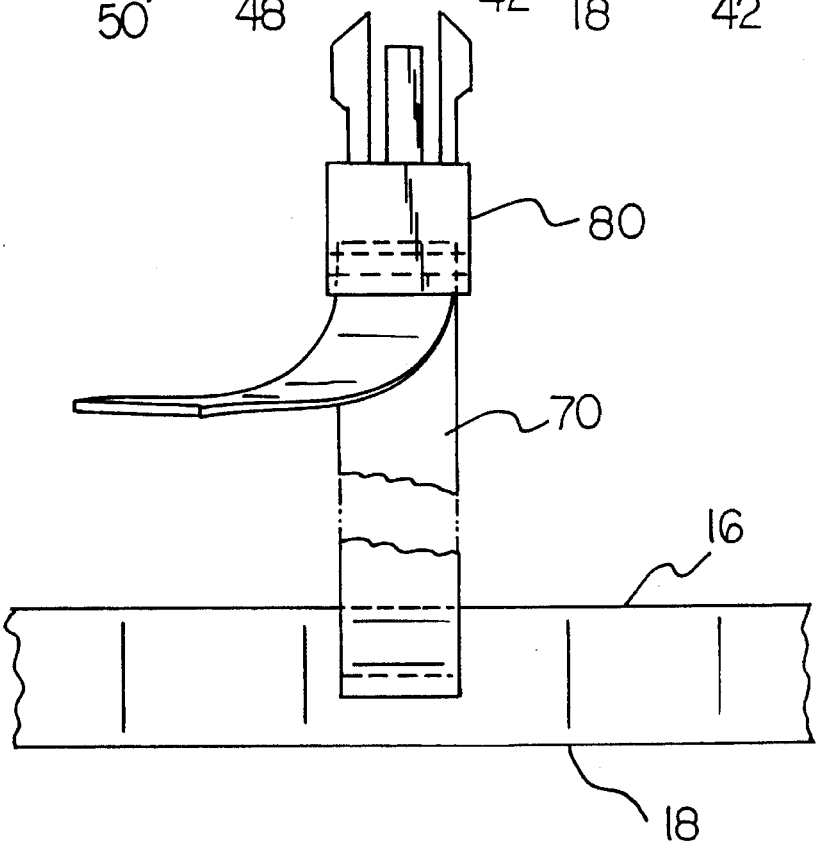
FIG. 3 is an enlarged side view of the device shown in FIG. 2 taken along line 3—3.
Figure 5:
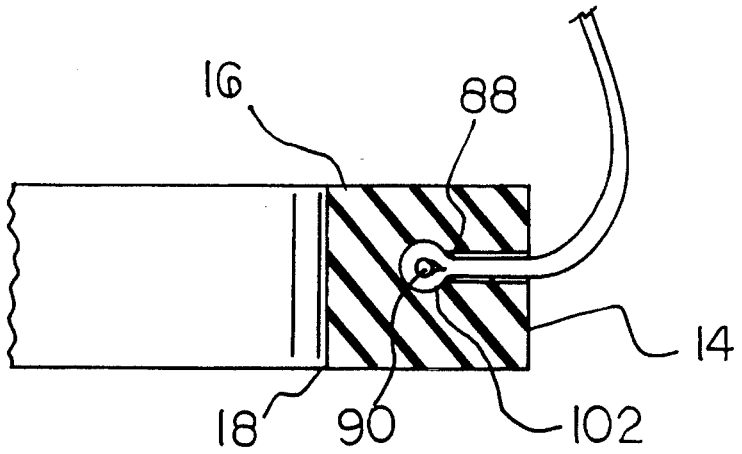
FIG. 5 is a cross-sectional view of the device taken along line 5—5 of FIG. 4.
Figure 4:
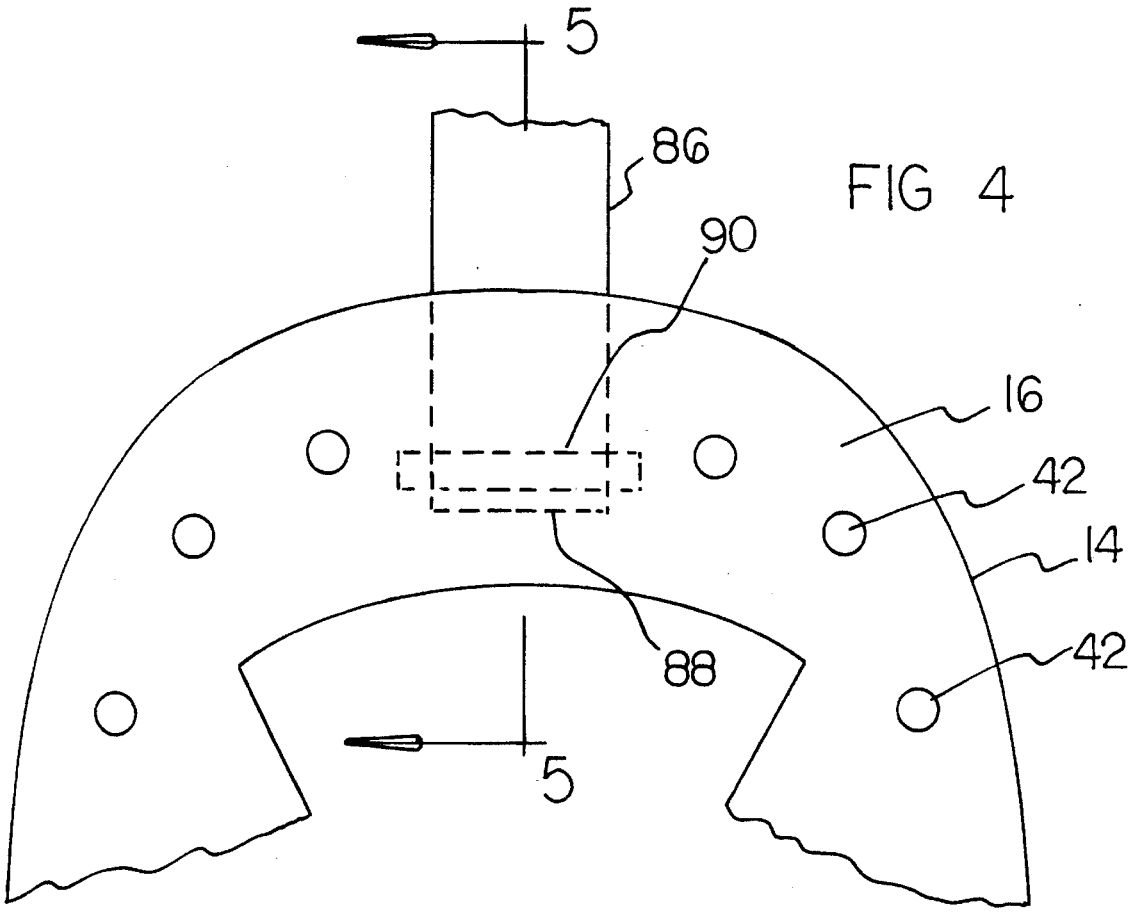
FIG. 4 is a plan view of the heel portion of the device of the prior Figures.

With reference now to the drawings, and in particular to FIG. 1 thereof, the new and improved ice cleats embodying the principles and concepts of the present invention and generally designated by the reference numeral 10 will be described.

Specifically, it will be noted in the various Figures that the device relates to a new and improved ice cleat for securing to existing footwear to aid in walking on icy surfaces. In its broadest context, the device consists of a base piece, holes through the base piece, nails through the holes, a plurality of strap pairs, attachment straps and openings in the base piece for the strap pairs and straps. Such components are individually configured and correlated with respect to each other so as to attain the desired objective.

The central component of the system 10 of the present invention is a base piece 12. The base piece is preferably formed in a one-piece construction of a relatively hard piece of elastomeric material, plastic or rubber, natural or synthetic, including blends thereof, be sufficiently flexible to bend with the foot of the wearer during walking but sufficiently rigid and resilient to return to its original planar configuration after walking has seised.

The base piece has a foot-like shaped periphery 14. It also has an upper surface 16 and a lower surface 18. Between the upper and lower surfaces is a toe portion 20 at the front, the heel portion 22 at the rear, as well as a right side portion 24 and a left side portion 26 coupling the heel and toe portions. The base piece also has a front open section 28 with cross braces 30 therein. The cross braces form four generally triangular openings 32. The back section 34 is also formed with cross braces 36 which form four generally triangular openings 38. A generally rectangular open 40 is located at the center making an open section 42 between the front and rear cross braces. The openings in the base piece provide for additional traction when walking with the devices of the present invention on a snowy surface.

Next provided are a plurality of holes 44. Such holes extend through the base plate from the upper surface to the lower surface. They are located around the entire peripheral shape of the base piece. They also extend through the front cross brace, the rear cross brace and around the center open sections. The holes are of a common cylindrical configuration throughout their extents.

Next provided are a plurality of nails 46. The nails each have a lower end 48 formed with a point 50. The nails each have an upper end 52 with a head 54. The head of the nail is adapted to be positioned upon the upper surface of the base piece with a point extending downwardly beyond the lower surface. A preferred distance of extension from the lower surface is between about 0.25 and 0.50 inches. Variations of this dimension may be utilized as a function of the extent of the snow for particular locations.

The nails each have a common diameter correlated to the diameter of the holes in which the are located so as the nails are fictionally supported within each associated hole.

Securement of the base piece to the foot piece of a wearer is effected by a strap system. Such strap system includes a forward strap pair 58, 60. Each strap of the pair has an interior end 62 formed with a loop 64. A rod 66 extends therethrough. The interior ends are secured to the side portion of the base piece at the periphery of the base piece. The strap system also includes a rearward strap pair 68, 70. Such strap pair has an interior end 72 with a loop 74 and rod 76 therethrough. The interior end of the strap pair are secured to the side portions of the periphery of the base piece. Each strap pair has an external end 78 with a male buckle member 80 on one strap of the pair and a female buckle member 82 on the other strap of the pair. These are releasably couplable to allow for the removable coupling of the base piece to the foot piece of the wearer.

The strap system further includes a front attachment strap 84 with an interior end 86 having a loop 88 and rod 90 therethrough. Such interior end is secured to the toe portion at the periphery of the base piece. Also provided is a rear attachment strap 92. The rear attachment strap has a loop 94 with a rod 96 therethrough. Such strap is secured to the heel portion of the periphery of the base piece. The front strap piece has a loop 98 at its outboard end for receiving the front strap pair and a rear strap piece having a loop 100 at its outboard end for receiving a portion of the rear strap pair. In this manner, the various straps of the strap system function one with respect to the other for the intended purpose of securing the base piece to the foot piece of a wearer. Further securement of the various straps to the base piece are effected through openings 102 in the base piece. Such openings have enlarged areas interiorly and extend from interior of the base piece to the periphery of the base piece where the opening is smaller, sufficient merely to support the appropriate strap. It is preferred that these openings 102 and the interior ends of the straps are molded into the base piece during fabrication for receiving the interior end of the strap pairs and straps for added securement between the base piece, straps and strap pairs. Further securement therebetween may be effected through enlargements at the ends at the rod located within the loops of the straps which are molded into the base piece.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved ice cleat for securing to existing footwear to aid in walking on icy surfaces comprising, in combination:

a base piece having a foot-like shape periphery, the base piece having an upper surface, a lower surface, a toe portion, a heel portion, a right side portion, and a left side portion, the base piece having a front open section with cross braces to form four generally triangular openings, a back open section with cross braces to form four generally triangular openings and a center generally rectangular opening;

a plurality of holes extending through the base piece from the upper surface to the lower surface around the entire peripheral shape as well as through the front cross brace, rear cross brace and around the center open section;

a plurality of nails having a lower end with a point and an upper end with a head, the head being positioned upon the upper surface with the point end extending beyond the lower surface for a distance of between about 0.25 and 0.50 inch, its nails having a common diameter such as to be fictionally supported within its associated hole;

a forward strap pair having interior ends with a loop and rod therethrough secured to the side portion at the periphery of the base piece and a rearward strap pair having interior ends with a loop and rod therethrough secured to the side portion at the periphery of the base piece, each strap pair having an external end with a male buckle member and a female buckle member to allow for the removable coupling therebetween;

a front attachment strap having an interior end with a loop and rod therethrough secured to the toe portion of the periphery of the base piece and a rear attachment strap having an internal end with a loop and rod therethrough secured to the periphery of the base piece, the front strap piece having a loop at an outboard end thereof for receiving the front strap pair and the rear strap piece having a loop at its outboard end for receiving a portion of the rear strap pair; and openings in the base piece extending from the interior of the base piece to the periphery of the base piece and molded into the base piece for receiving the interior end of the strap pairs and straps for added securement between the base piece, the straps and strap pairs.

* * * * *